United States Patent [19]

Bakker et al.

[11] 4,373,237

[45] Feb. 15, 1983

[54] METHOD OF MANUFACTURING A COLOR TELEVISION DISPLAY TUBE

[75] Inventors: Gijsbertus Bakker; Theodorus C. Groot, both of Eindhoven, Netherlands

[73] Assignee: U.S. Philips Corporation, New York, N.Y.

[21] Appl. No.: 129,502

[22] Filed: Mar. 11, 1980

[30] Foreign Application Priority Data

Dec. 27, 1978 [NL] Netherlands ..... 7812542

[51] Int. Cl.[3] ..... H01J 9/26

[52] U.S. Cl. ..... 445/3; 430/23

[58] Field of Search ..... 220/2.1 R, 2.1 A; 29/25.13, 25.19; 313/317

[56] References Cited

U.S. PATENT DOCUMENTS

| | | | |
|---|---|---|---|
| 3,285,457 | 11/1966 | Peterson | 220/2.1 A |
| 3,369,881 | 2/1968 | Bennett et al. | 220/2.1 A |
| 3,381,347 | 5/1968 | Reinwall, Jr. | 220/2.1 A |
| 3,806,108 | 4/1974 | Adachi et al. | 29/25.19 |
| 3,904,914 | 9/1975 | Palac | 220/2.1 A |
| 3,971,490 | 7/1976 | Conger | 313/482 |
| 4,028,580 | 6/1977 | Dougherty | 220/2.1 A |
| 4,050,602 | 9/1977 | Tom et al. | 220/2.1 A |

*Primary Examiner*—John McQuade

*Attorney, Agent, or Firm*—Robert J. Kraus

[57] ABSTRACT

In a method of manufacturing a color television display tube, marks for the positioning of the display window are provided on the funnel part of the tube. Upon providing the marks the funnel part is fixed in a centering device which locates in the funnel part a reference point to which the provision of the marks is referenced. The reference point is situated in or substantially in the deflection center of a deflection device provided afterwards on the funnel part.

8 Claims, 5 Drawing Figures

METHOD OF MANUFACTURING A COLOR TELEVISION DISPLAY TUBE

BACKGROUND OF THE INVENTION

The invention relates to a method of manufacturing a color television display tube having a substantially rectangular display window and a funnel part which is substantially rectangular at its wide end. The rectangular end of the funnel part has two mutually perpendicular axes and a supporting surface for the display window. The funnel part is also provided with marks with respect to which the display window is positioned on the supporting surface of the funnel part.

The invention further relates to a device for carrying out this method, as well as to a color television display tube manufactured according to this method.

In manufacturing color television display tubes it is usual to remove color impurities and convergence errors of the tube by means of a number of correction means. These color impurities and convergence errors are a result of inaccurate adjustment of the various components including the display window, the funnel part, the electron gun and the deflection device relative to each other during assembly of the tube. Also, because of limitations in the accuracy with which the components themselves can be manufactured, the same components are not identical to each other.

Several reference systems are known for the adjustment of the various components of the tube. A typical reference system is disclosed in U.S. Pat. No. 3,971,490. In accordance with this patent, reference surfaces are ground on the funnel part of the tube, the axis of the neck of the funnel part being referenced to the ground reference surfaces. The display window at the circumference thereof comprises reference points with respect to which the display screen is provided on the display window. The display window is positioned on the funnel part by use of the reference points of the display screen and the reference surfaces of the funnel part which are referenced to a common reference R. In this manner the display screen is referenced to the axis of the neck of the funnel part. It is assumed that the effective source of the electron beams which are generated by an electron gun to be provided afterwards in the neck, is situated on the axis of the neck so that this effective source is also referenced to the display screen. When using such a reference system, however, it is necessary for the supporting surface of the funnel part destined for the display window to be perpendicular to the axis of the neck. In practice, however, it has been found that it is almost impossible to grind the supporting surface perpendicularly to an axis with the required accuracy. Furthermore, when using said reference system individual positioning of the deflection device is necessary so as to bring the deflection center determined thereby on the axis of the tube neck. The step of adjusting the deflection device of the funnel part is time-consuming and increases production costs. Therefore there exists a need for a system which minimizes the number of operations and adjustments to position a deflection device on the funnel part of a display tube.

SUMMARY OF THE INVENTION

It is an object of the invention to provide a method for manufacturing a color television display tube which enables positioning of a deflection device on the funnel part of the tube within permissible tolerances by means of a few simple operations.

According to the invention, a method is provided for manufacturing a color television display tube having a substantially rectangular display window and a funnel part which is substantially rectangular at its wide end. The rectangular end of the funnel part has two mutually perpendicular axes and a supporting surface for the display window. The funnel part is provided with marks with respect to which the display window is positioned on the supporting surface. The marks are provided so as to be referenced to a reference point situated inside the funnel part. The location of the reference point is fixed by a centering system which fixes the funnel part during the provision of the marks. The reference point is situated in or substantially in the deflection centre of a deflection device to be provided afterwards on the funnel part.

The manufacture of a deflection device may be carried out with small tolerances. This means that the location of the deflection center relative to defined points of the device is accurately determined. By choosing the location of the deflection center in the tube as a starting point, during the manufacture of the display tube, and referencing the provision of marks to adjust the various components such as a display window and funnel part, to the location of the deflection center, the display screen provided on the display window is accurately referenced to the deflection center. So it is necessary for the location of the deflection center to be known in an early stage of the manufacturing process of the tube. For that purpose, in order to fix the funnel part of the tube, a centering system is used which fixes, within the funnel part, a reference point which is situated in or substantially in the deflection center of the deflection device provided afterwards on the funnel part. Deflection center is to be understood to mean herein the center in which, for an imaginary electron beam whose center line coincides with the longitudinal axis (electron-optical axis) of the deflection device, the deflection action of the field of the deflection device can be considered to be concentrated. The deflection center is a collection of points, termed deflection points, from which, viewed from the display screen, the electrons apparently emerge. So the deflection center is synonymous with what was previously called the effective source of the electron beams.

In an embodiment of the invention, the part of a mark destined for the positioning of a display window is provided at a previously determined distance from a plane comprising the reference point fixed by the centering system, being parallel to one side of the rectangular end of the funnel part and being perpendicular to the supporting surface of the funnel part destined for the display window. The above "previously determined distance" is fixed by the exposure table by means of which the display screen is provided photographically in known manner on the display window with respect to marks situated on the circumference of the display window. The advantage of this embodiment of the invention is that the supporting surface of the display window need not be ground so as to be perpendicular to the geometric axis of the funnel part. The supporting surface may be formed either by the total end face of the funnel part or by three studs projecting from the end face of a funnel part. The marks may be reference surfaces at the surface of the funnel part or reference surfaces on ribs, studs or recesses provided on the funnel part. The reference surfaces may be provided parallel or substantially parallel to the sides of the rectangular end of the funnel part.

When the reference surfaces are ground by means of a grinding device, the centering system is arranged so as to be rotatable about the reference point fixed thereby. The funnel part is placed in the centering system and the centering system is rotated about the reference point until the supporting surface of the funnel part destined for the display window is at least substantially perpendicular to the grinding surfaces of the grinding device. For a display tube having a display screen including continuous phosphor lines, it is sufficient to arrange the centering system so as to be rotatable about an axis which passes through the reference point and is parallel to the direction of the phosphor lines. In the case of a hexagonal pattern of phosphor regions, the centering system is suspended cardanically around the reference point fixed thereby.

In a further embodiment of the invention the centering system fixes the funnel part in points on the outer circumference of the funnel part, which points coincide or substantially coincide with positioning points of a deflection device to be provided afterwards on the funnel part. In this case the centering device may be a dummy deflection device.

BRIEF DESCRIPTION OF THE DRAWING

The invention will now be described in greater detail, by way of example, with reference to the drawing in which.

DESCRIPTION OF THE PREFERRED EMBODIMENTS

Figure 1:
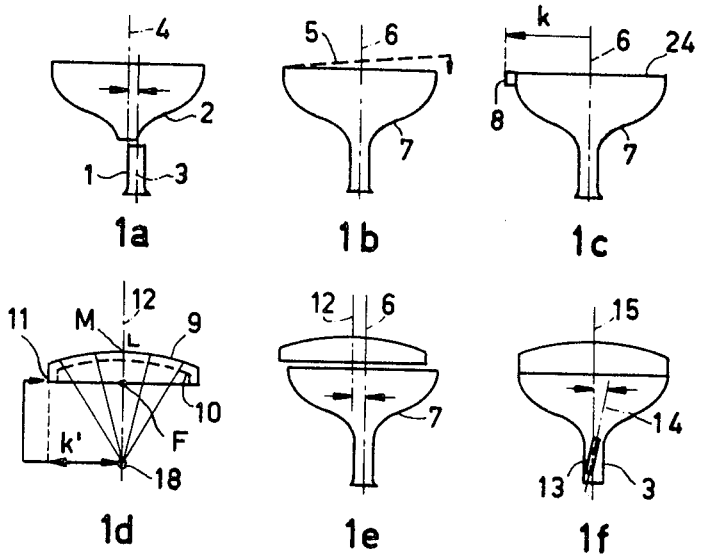
FIG. 1 PRIOR ART
FIGS. 1*a*, 1*b*, 1*c*, 1*d*, 1*e* and 1*f* show a known reference system for manufacturing a color television display tube.

FIG. 1*a* shows the sealing of a neck 1 to a cone part 2 in which the geometrical axis 3 of the neck 1 is aligned with the geometrical axis 4 of the cone part 2 so that a funnel part 7 having a geometrical axis 6 is obtained. FIG. 1*b* illustrates the grinding of the supporting surface 5 (cone edge 5) perpendicular to the geometrical axis 6 of the funnel part 7. FIG. 1*c* relates to the grinding of a reference surface 8 parallel to the axis 6 of the funnel part 7 in such manner that the reference surface 8 is situated at a distance k from the plane which passes through the axis 6 and is parallel to one side of the rectangular end of the funnel part. The distance k is fixed by the exposure table by means of which a display screen is provided photographically on the display window. This is shown diagrammatically in FIG. 1*d*. In this figure, a layer of phosphor provided on the window 9 is exposed from an effective light source (exposure point 18), through a shadow mask 10. The window 9 is positioned on an exposure table (not shown) in such manner that reference marks on the periphery of the window bear against positioning studs of the exposure table. One of these marks is designated 11, and the indicated distance k' corresponds to the distance k shown in FIG. 1*c*. In this generally known manner the display window 9 is provided with a display screen which is constructed from a pattern of phosphor regions luminescing in three colors (red, green and blue). In this manner the display screen is referenced to an axis 12 which passes through the exposure point 18, is perpendicular to the window 9 and intersects the display screen in the point M. After providing the display screen on the display window 9, the window is positioned on the funnel part 7 in which, as shown in FIG. 1*e*, the axis 12 of the window 9 is aligned with the axis 6 of the funnel part 7. The window 9 and the funnel part 7 are then secured together by means of a sealing glass. Finally, as shown in FIG. 1*f*, an electron gun 13 is positioned in the neck 1 in such manner that the longitudinal axis 14 of the electron gun 13 coincides with the longitudinal axis 15 of the assembly formed by the neck 1, the cone 2 and the display window 9.

The step in the manufacturing process of the tube shown in FIG. 1*b*, that is the perpendicular grinding of the cone edge 5 on the axis 6, proves to be almost impossible in practice. The error to which an oblique cone edge 5 gives rise in the picture display of the display tube will be described with reference to FIG. 2. It is assumed that the assembly of the various components of the tube as described above has taken place within certain tolerances but the supporting surface (the cone edge) for the display window has been ground oblique with respect to the axis 6 over an angle $\alpha$. Shown is one of the three electron beams landing in the point M situated in the center of the display screen, for example, the electron beam generated by the electron gun 13 and destined for the green luminescing phosphor regions. On their way to the display screen the electron beams pass through a correction device for carrying out static corrections on the electron beams. By means of these corrections the electron beams pass through the exposure points of the display screen (landing correction) and as regards the center of the display screen converge in one point (static convergence). For convenience in FIG. 2 this correcting effect is considered to be concentrated in a plane 20 perpendicular to the plane of the drawing. The electron beams then pass through a deflection device 21 for deflecting the electron beam. In this case also, again for convenience, the deflecting effect has been deemed to be concentrated in a plane 22 (deflection plane) perpendicular to the plane of the drawing, in which the deflection points for the three electron beams are situated. The location of the deflection points which collectively form the deflection center corresponds to the location of the exposure points relative to the display screen. After deflection, the electron beams pass through a shadow mask 10 and finally land on the display screen 23 provided on the display window 9. When the supporting surface 24 for the display window 9 has been ground to be perpendicular to the axis 6 (see FIG. 1*b*) ($\alpha=0°$), the electron beam considered here follows the path A-B-D-C-M. As a matter of fact, the longitudinal axis 14 of the gun 13, the longitudinal axis of the deflection device 21, and the axis 12 of the display window 9 coincide. When, however, the supporting surface 24 for the display window has been ground oblique over an angle $\alpha$, the electron beam should be directed to the display screen along to the axis 12 (see FIG. 1*d*) so as to avoid color impurity, that is to say the landing on a phosphor region of a wrong color. For that purpose, the direction of the electron beam should be changed in the correction plane 20 so that it passes through the point of intersection E of the axis 12 with the deflection plane 22 and thus follow the path A-B-E-F-M, the line E-F-M coinciding with the axis 12 (FIG. 1*d*). However, the result of this necessary correction is that the electron beam enters the deflection field via the path B-E eccentrically over a distance e and at an angle $\beta$ with the axis of the deflection device 21. As a result of this, convergence errors arise and the three electron beams do not coincide on the display screen.

Figure 3:
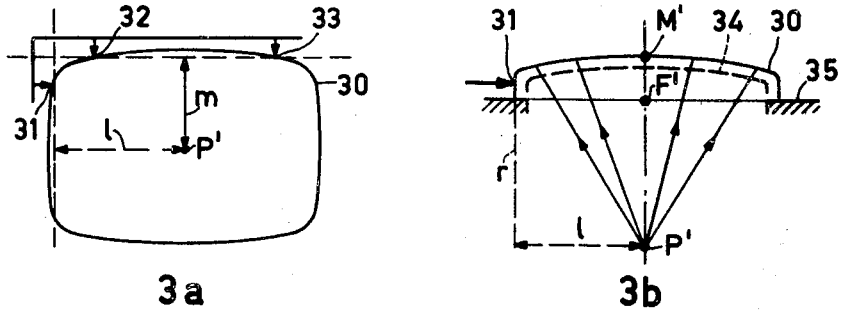
FIGS. 3*a* and 3*b* are a diagrammatic plan view and a diagrammatic side elevation, respectively, of the provision of a display screen on a display window by means of an exposure table.

Such errors can be avoided by using the method of the invention. FIGS. 3*a* and 3*b* illustrate the provision of a display screen on a display window 30. As shown in FIG. 3*a*, the display window is laid on an exposure table (not shown) against three abutment points 31, 32 and 33. With respect to the points 31, 32 and 33 an axis is defined perpendicular to the plane of the drawing on which the exposure point P′ is situated. In FIG. 3*b* this axis is denoted by P′M′. The distance from point 31 to a plane through P′ perpendicular to the plane of the drawing and parallel to a short side of the window 30 is denoted by l. The distance from point P′ to a plane through the points 32 and 33 and perpendicular to the plane of the drawing is denoted by m. For reasons of clarity, the process will be described for the provision of the green phosphor regions so that point P′ is the exposure point for the green phosphor regions of the display screen. In fact, there are two more exposure points for the red and blue phosphor regions, respectively. These points are situated very near to point P′ and together constitute an exposure center corresponding to the deflection center of the deflection device to be subsequently provided on the display tube. The device will be further explained with reference to the display tube in which the phosphor regions are provided according to phosphor lines extending parallel to the short sides of the display window. These starting points for explaining the invention do not involve any restriction of the applicability of the invention. The invention may be used for any pattern of phosphor regions and the simplifications introduced do not narrow the scope of the invention. As shown in FIG. 3*b* the display window with a phosphor layer provided thereon is exposed from point P′ via the shadow mask 34, point P′ being situated at a distance r from the supporting surface 35 of the exposure table.

Figure 4:
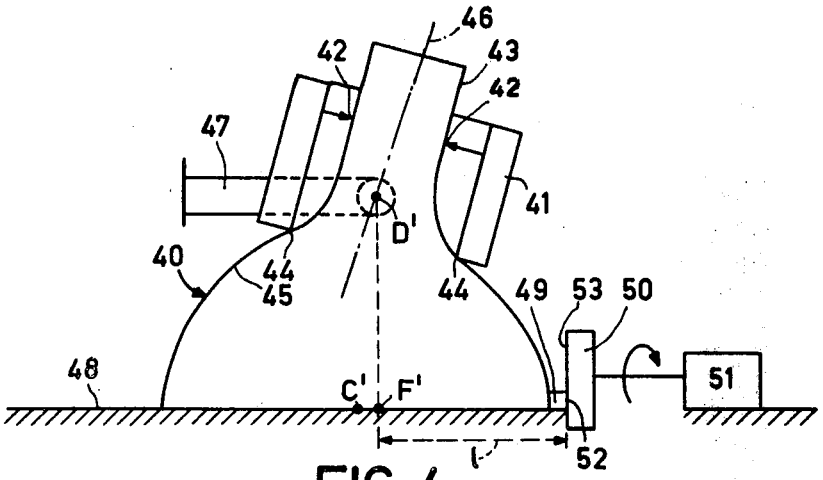
FIG. 4 shows the grinding of marks on a funnel part according to an embodiment of the method in accordance with the invention.

For correct positioning of the display window on the funnel part of the tube it is sufficient for the point P′ to correspond to a point in the tube which is situated in or substantially in the deflection center of the deflection device. In order to achieve this, marks for the positioning of the window 30 are provided on the funnel part of the tube in the manner shown in FIG. 4. A funnel part 40 previously ground to length is placed in a centering device 41 which fixes in the funnel part 40 a reference point D′ which is situated in or substantially in the deflection center of a deflection device to be subsequently provided on the funnel part. The simplest manner of achieving this is to use a centering device which, after having been provided on the funnel part, engages the outer circumference of the funnel part in the same points as the deflection device does. The centering device 41 may be, for example, a dummy deflection device. The centering device 41 engages the funnel part 40 in three points 42 on the neck 43 and in three points 44 on the cone part 45 of the funnel part 40. The axis 46 of the centering device 41 corresponds to the axis of a deflection device to be provided afterwards. The centering device is mounted in a frame 47 so as to be rotatable about an axis through D′ perpendicular to the plane of the drawing. The axis through D′ is parallel to the short sides of the rectangular end of the funnel part 40 when it has been placed in the centering device. The supporting surface of the funnel part 40 destined for the display window 30 is then urged against a surface 48 so that the funnel part assumes an oblique position as a result of the obliquely ground supporting surface, as is shown in FIG. 4. In the drawing this obliqueness has been strongly exaggerated so as to better illustrate the effect of the invention. A reference surface 52 is then ground on a stud 49, situated on a short side, by means of a grinding wheel 50 driven by a motor 51. The grinding surface 53 of the grinding wheel 50 is perpendicular to the surface 48. Enough material is removed from the stud 49 so that the ground reference surface 52 is situated at a distance l from the plane which passes through D′, is perpendicular to the surface 48 and is parallel to the short sides of the rectangular end of funnel part 40. This distance l corresponds to the distance l shown in FIGS. 3*a* and 3*b*. In a corresponding manner, surfaces are ground on two studs on the long side of the rectangular end of the funnel part 40, in which the plane through the ground surfaces of the studs is situated at a distance m corresponding to the distance m in FIG. 3*a* of the point D′. In the present case the accuracy with which the studs on the long side are ground with respect to the distance m need be less accurate than that with respect to the distance l because a display screen moved slightly in the longitudinal direction of the phosphor lines does not produce color impurity with respect to the landing of an electron beam. In case of a hexagonal pattern of phosphor regions of the display window, the grinding of all the studs destined for the positioning of the display window should be carried out accurately. In that case the centering device 41 is also suspended so that it can be inclined in any direction around the point D′ fixed thereby, for example in a manner as is usual for a mariner's compass. After grinding the studs 49 the display window 30 is positioned on the rectangular end of the funnel part 40. The ground surfaces of the studs 49 which correspond to the locations where in FIGS. 3*a* and 3*b* the abutments 31, 32 and 33 press against the display window, are aligned in a jig with the locations determined by the abutments 31, 32 and 33 at the display window. The display window 30, positioned in this manner, is secured in a vacuum-tight manner to the funnel part 40. Since the funnel part has been ground to length in such manner that the distance D′F′ in FIG. 4 corresponds to the distance r (P′F′) in FIG. 3*b*, the point D′ lies in the deflection center of a deflection device to be subsequently provided on the funnel part 40, and the location of the point D′ with respect to the display window 30 corresponds or substantially corresponds to the location of the point P′ relative to the display window 30 in FIG. 3*b*, so that the condition imposed with respect to a correct positioning of the display window on the funnel part is satisfied. For grinding to length, the funnel part may be placed in a centering device 41 for fixing and be ground to length with respect to point D′. An electron gun is finally provided in the neck 43, in which the longitudinal axis of the gun, at least at the plane 20 shown in FIG. 2, is aligned with the axis 46 of the deflection device.

Figure 2:
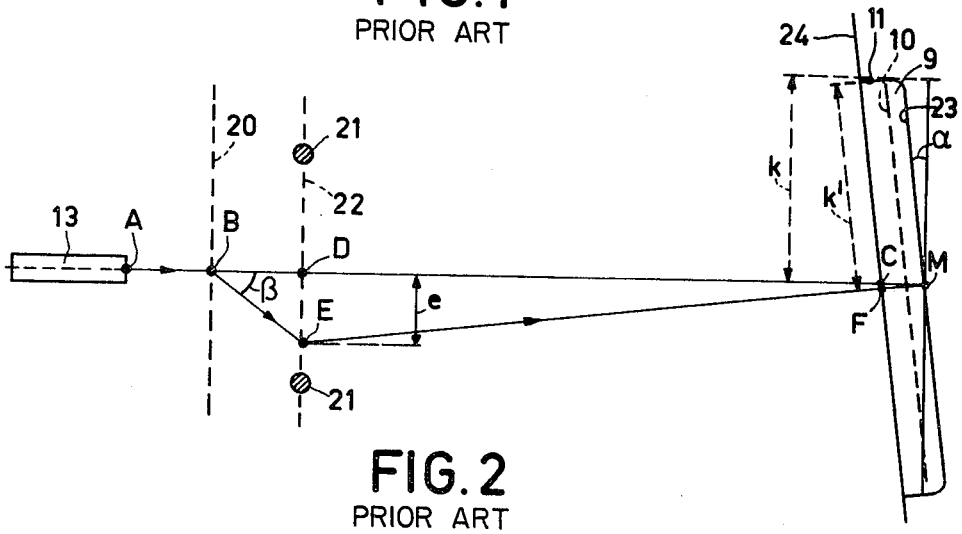
FIG. 2 PRIOR ART
FIG. 2 shows the path of rays of an electron beam in a tube assembled according to the reference system shown in FIGS. 1*a* to 1*f* with a funnel part which is ground oblique.
Figure 5:
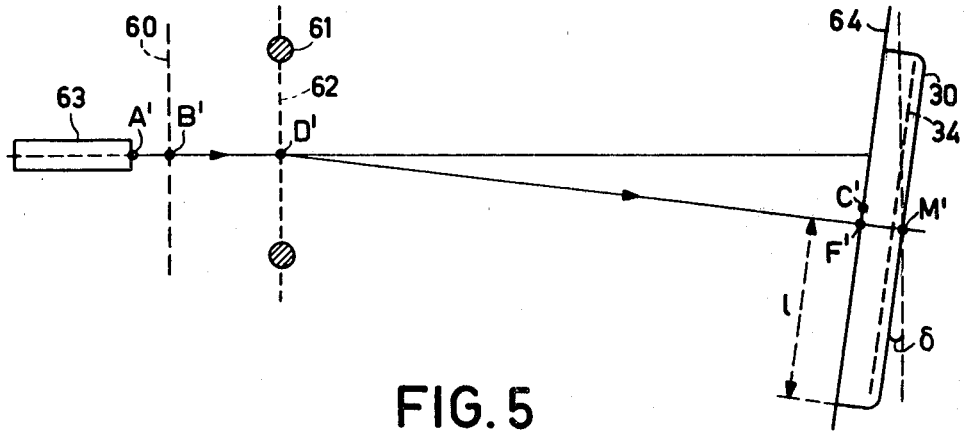
FIG. 5 shows the path of rays of an electron beam in a display tube manufactured according to the invention.

For comparison, FIG. 5 shows the path of a corresponding electron beam as considered in FIG. 2. The plane 60 corresponds to the plane 20. The deflection device 61 and the deflection plane 26 correspond to the deflection device 21 and the deflection plane 22. For a true color display according to FIG. 3*b*, the electron beam directed to the point M′ should approach the display screen according to the line P′M′. According to FIG. 5, in which the distance l is also shown, this occurs according to the line D′M′. According to the invention, in spite of the obliqueness at an angle δ of the supporting surface 64, the point D′ assumes a corresponding position with respect to the display window as point P′. The electron beam destined for the point M′ hence reaches this point along the path A′-B′-D′-F′-M′. However, no convergence errors occur in this case because the electron beam enters the deflection field via the path A′-B′-D′ according to the axis of the deflection device.

By using a centering device 41 (FIG. 4) which engages the tube in the same points as the deflection device, the positioning of the deflection device has been reduced to a simple operation. In fact, sliding the deflection device on the tube neck until it bears on the cone part automatically results in the correct position of the deflection device in the longitudinal direction of the tube. Three positioning studs may be provided on the cone part on which both the centering device 41 and the deflection device engage. One of these studs may then be used to fix the rotation position of the deflection device around its longitudinal axis.

What is claimed is:

1. A method for providing reference marks on a funnel of a color television display tube, with respect to which a display window will be positioned on a supporting surface at a rectangular end of the funnel during manufacture of the tube, said display window having a centrally-located axis perpendicular thereto which will pass through a deflection center defined by a deflection device subsequently mounted on the tube, said method comprising the steps of:

(a) attaching a centering system to the funnel at the location where the deflection device will be subsequently mounted, said centering system locating a reference point corresponding to the deflection center; and (b) providing the reference marks at predetermined distances from an axis which passes through the reference point and perpendicularly intersects a plane defined by the supporting surface at the end of the funnel.

2. A method as in claim 1, characterized in that each reference mark is provided at a predetermined distance from a plane passing through the reference point located by the centering system, the plane being substantially parallel to one side of the rectangular end of the funnel and being perpendicular to the supporting surface of the funnel.

3. A method as in claim 1 or 2, characterized in that the marks comprise reference surfaces.

4. A method as in claim 3, characterized in that each reference surface is provided parallel to a side of the rectangular end of the funnel.

5. A method as in claim 4, characterized in that the reference surfaces are ground on studs of the funnel.

6. A method as in claim 5, wherein the reference surfaces are ground by arranging the centering system relative to a grinding device such that the supporting surface of the funnel part is perpendicular to grinding surfaces of the grinding device and grinding the studs until the reference surfaces are provided at their predetermined distances.

7. A method as in claim 6, characterized in that the centering system is suspended so that it can be inclined in any direction around the reference point fixed thereby.

8. A method as in claim 2, characterized in that the centering system engages the funnel at points on its outer circumference which coincide with positioning points for the deflection device.

* * * * *

UNITED STATES PATENT AND TRADEMARK OFFICE

CERTIFICATE OF CORRECTION

PATENT NO. : 4,373,237

DATED : February 15, 1983

INVENTOR(S) : GIJSBERTUS BAKKER ET AL

It is certified that error appears in the above—identified patent and that said Letters Patent is hereby corrected as shown below:

IN THE TITLE PAGE:

Delete "Dec. 27, 1978 [NL] Netherlands.....7812542"

Signed and Sealed this

Twenty-sixth Day of April 1983

[SEAL]

*Attest:*

GERALD J. MOSSINGHOFF

*Attesting Officer*

*Commissioner of Patents and Trademarks*